US005134935A

United States Patent [19]

Hayes et al.

[11] Patent Number: 5,134,935

[45] Date of Patent: Aug. 4, 1992

[54] LITHOGRAHIC DAMPENER

[75] Inventors: Thomas Hayes, McAfee; Robert Wall, Prospect Park, both of N.J.

[73] Assignee: Yarn Products Company, Inc., Oakland, N.J.

[21] Appl. No.: 592,150

[22] Filed: Oct. 3, 1990

Related U.S. Application Data

[63] Continuation-in-part of Ser. No. 420,201, Oct. 12, 1989, abandoned.

[51] Int. Cl.[5] ..... B41L 25/02

[52] U.S. Cl. ..... 101/148; 101/363

[58] Field of Search ..... 101/148, 363, 367

[56] References Cited

U.S. PATENT DOCUMENTS

| | | | |
|---|---|---|---|
| 3,283,741 | 11/1966 | Brodie | 101/350 |
| 3,343,484 | 9/1967 | Dahlgren | 101/148 |
| 3,559,569 | 2/1969 | Jurny | 101/148 |
| 4,841,855 | 6/1989 | Marcum | 101/148 |
| 4,852,515 | 8/1989 | Teraska et al. | 118/262 |

*Primary Examiner*—Edgar S. Burr

*Assistant Examiner*—Lynn D. Hendrickson

*Attorney, Agent, or Firm*—Joseph G. Nauman

[57] ABSTRACT

An improved lithographic dampener of the type having continuous plate/form roller/metering roller contact, adaptable to a variety of press configurations and operating speeds, employs a friction-driven oscillator roller that distributes added dampening liquid and the ink/liquid emulsions on the metering roller, to avoid continuing patterns which might cause ghosting in printed images. The dampener has a simple drawer-like configuration, with an open front for improved range of form roller/plate contact. A pan with a remote supply of dampening liquid, is located under the rollers such that the metering roller surface contacts and picks up liquid from a pool in the pan. Simplified seal dams at the ends of the form/metering rollers' nip keep the reservoir of liquid in that nip, yet minimize wear of the seal configuration. A slide block mounting of the metering roller and oscillator rollers allows independent adjustment of pressure at the form/metering rollers' nip, and at the metering/oscillator rollers' nip.

7 Claims, 5 Drawing Sheets

LITHOGRAHIC DAMPENER

CROSS-REFERENCE TO RELATED APPLICATION

This application is a continuation in part of application Ser. No. 420,201 filed Oct. 12, 1989, now abandoned, and assigned to the same assignee.

BACKGROUND OF THE INVENTION

This invention relates to improvements in lithographic dampeners, and particularly to the type of dampener described in U.S. Pat. No. 4,455,938 in which a dampening liquid is applied through a form roller, which is continually contacting a plate on the press, by a metering roller which is continually in contact with the form roller and the source of dampening liquid.

As described in that patent, a small reservoir of dampening liquid is formed in the nip above and between the form roller and metering roller, and the action of the two rollers is such as to mix or mill the ink and dampening liquid together to form an emulsion, which results in quick and uniform inking of the image areas of the plate and dampening of non-image areas. The ends of such nip are, in some embodiments, closed by seals which run tightly against the peripheral surface of the metering roller at its ends and against the end faces of the form roller. In another embodiment the metering roller carries dampening liquid to the nip from a pan, no seal is provided, and excess liquid at the nip flows outward and downward along the metering roller, which is longer than the form roller, returning to the pan.

In either case, those embodiments are somewhat disadvantageous, particularly at higher press speeds, since the friction from the tight seals increases with roller speed, as does seal wear. Further, if the press be operated at considerably different speeds, particularly if it is necessary to tighten the metering/form rollers' nip at higher operating speeds, the seals may leak as a result of their movement which is a consequence of increasing the nip pressure by moving the metering roller tighter against the form roller.

In the embodiment without seals there is a tendency to throw the liquid from the rollers onto adjacent press parts, instead of flowing along and with the longer end portions of the metering roller, and this will of course be more troublesome at higher roller speeds. Also the dampening liquid pan in that embodiment does not extend totally under the nip, so any collected liquid will tend to drip out of the dampener.

When the dampening liquid is supplied and replenished from a pan, in which the metering roller surface enters a pool in the pan, it is desirable to have some means for controlling the amount of liquid carried by the metering roller surface to the nip. In addition, especially printing either single color jobs with heavy ink deposit areas, or multi-color jobs with more than one heavy or bright color, there is a tendency with such dampeners to cause some ghosting of the printed image due to the repetitive return of ink in image areas, and dampening liquid in non-image areas, to the form roller and back to the metering roller. Thus, there is a need to avoid such repetitions or ghosting, and also to meter the amount of liquid carried on the metering roller from the pool to the metering/form rollers' nip.

SUMMARY OF THE INVENTION

The present invention provides an improved lithographic dampener in which the metering roller surface, in addition to being pressed against the resilient form roller surface, extends into a supply pool of dampening liquid which is maintained in a shallow pan at a controlled level. The pan extends under and beyond the metering/form rollers' nip, and in a rearward direction extends substantially beyond the rear or back plate of the dampener structure. An oscillator roller runs in contact with the metering roller, and functions to spread or smear the ink/liquid mixture on the metering roller surface, before the mixture is carried over the top of the metering roller into the nip. At the same time, the oscillator roller is pressed against the metering roller and performs the additional function of metering the amount of additional dampening liquid carried to the nip from the pool.

The dampener structure includes side members which are connected at their front (closest to the press plate cylinder) by rigid tie rods. At the other or rear ends of the side members, there is a backplate (or endcap) joining them, and the pan for dampening liquid supply is attached to the bottom of the side members. A remote supply bottle is joined to a height adjustable level maintaining valve at the pan, so as to keep a constant preselectable level of liquid available to the metering roller.

Each side member has a slide track extending forward from the endcap toward the tie rods, and including a vertically enlarged rearward section. Slide blocks are received in the respective tracks and have inwardly facing bosses supporting the end bearings of the metering roller. Springs act between the side members and slide blocks, urging the blocks toward the endcap, and at each rear corner there are adjustment screws which press against the slide blocks, urging them forward against the springs and thus setting the pressure of the metering roller against the form roller.

At the forward end of the side frames there are bearings which support opposite ends of the form roller shaft. Outside one side member, a form roller drive gear is fixed to the form roller shaft and meshes with the plate cylinder gear of the press when the dampener is in operative position, to cause counter rotation of the form roll and plate cylinder. To allow for enlarging or up-sizing of the dampener construction, rigid form roller, metering roller, and oscillating roller constructions are employed which can be lengthened along with the tie rods and endcap while achieving the needed rigidity.

Instead of arcuate seals with different sealing surfaces, this design uses simple plate-like flexible end seals which are pressed against the ends of the metering and form rollers (which are of the same length). These seal plates form end dams which allow some leakage of liquid between them and the roller ends. This leakage provides some lubrication between the stationary seal plates and the rotating roller ends, deflects any liquid which may flow rapidly toward the ends of the nip into the pan, and controls the level of the reservoir of liquid in the nip by providing an overflow exit at least at one end. Since there is low friction in this arrangement, it is long lasting and effective over a range of roller speeds.

The open front dampener frame construction permits the form roller to contact a printing plate (on the plate cylinder) over a substantial range of locations around the plate cylinder periphery. This simplifies mounting of the dampener to different press configurations, thus the design has retrofit advantages. In a similar way, the metering/form rollers' nip location can be varied considerably, as by a change in side member shape and dimensions, so long as there is enough volume above that nip and between the seal plates.

Two forms of mounting support are provided for this unique dampener structure. In one form, slotted brackets are attached to the outer parts of the dampener side members, and the slots in these brackets are engaged with bushing fitted to the press side frames. At the end where the form rollers is mounted, a supporting shaft extends through the bearings of the form roller and outward through the dampener side members, into bushings (or equivalent) fitted to the press side members.

In another form of mounting, a "drawer-like" arrangement is provided, which is easy to mount for motion toward and away from the plate cylinder. In this embodiment, the dampener side members have pairs of rollers which can be supported in slides fitted to the interior of the press side frames. This allows the dampener to be inserted into such slides and precisely located between the press side frames to achieve the desired fitting of the form roller to the surface of the press plate cylinder.

In the specific embodiment illustrated and described, the form roller is gear driven from the plate cylinder gear (which in turn is coupled to the press drive). In small sizes, this is adequate to accommodate disengaging motion of the dampener mechanism, as may be desired in makeready or other non-printing press function. However, in larger sizes, as for commercial multicolor presses, it is desirable to drive the metering roller through a gear drive, and to throw-off the dampener by a motion which centers around the metering roller axis and its drive. This may be desired also from the standpoint that larger presses may use helical gears for increased power transmission, and it is not practical to partially disengage a helical gear train.

Accordingly, the primary object of this invention is to provide an improved lithographic dampener of the type having continuous plate/form roller/metering roller contact, in which the dampener is adaptable to a variety of press configurations and operating speeds; to provide such a dampener which also employs a friction-driven oscillator roller that distributes added dampening liquid and the ink/liquid emulsions on the metering roller, to avoid continuing patterns which might cause ghosting in printed images; to provide such a dampener with a pan with a remote supply of dampening liquid, located under the rollers such that the metering roller surface contacts a picks up liquid from a pool in the pan, and wherein the oscillator roller acts to meter the amount of liquid thus applied to the metering roller surface; to provide such a dampener having a simple drawer-like configuration, with an open front for improved range of form roller/plate contact; to provide novel mounting arrangements for such a drawer-like dampener structure; to provide such a press with simplified seal dams at the ends of the form/metering rollers' nip which will keep the reservoir of liquid in that nip, yet minimize wear of the seal configuration; and to provide simple slide block mounting of the metering roller and oscillator rollers which allows independent adjustment of pressure at the form/metering rollers' nip, and at the metering/oscillator rollers' nip.

Other objects and advantages of the invention will be apparent from the following description, the accompanying drawings and the appended claims.

DESCRIPTION OF THE PREFERRED EMBODIMENT

Figure 1:
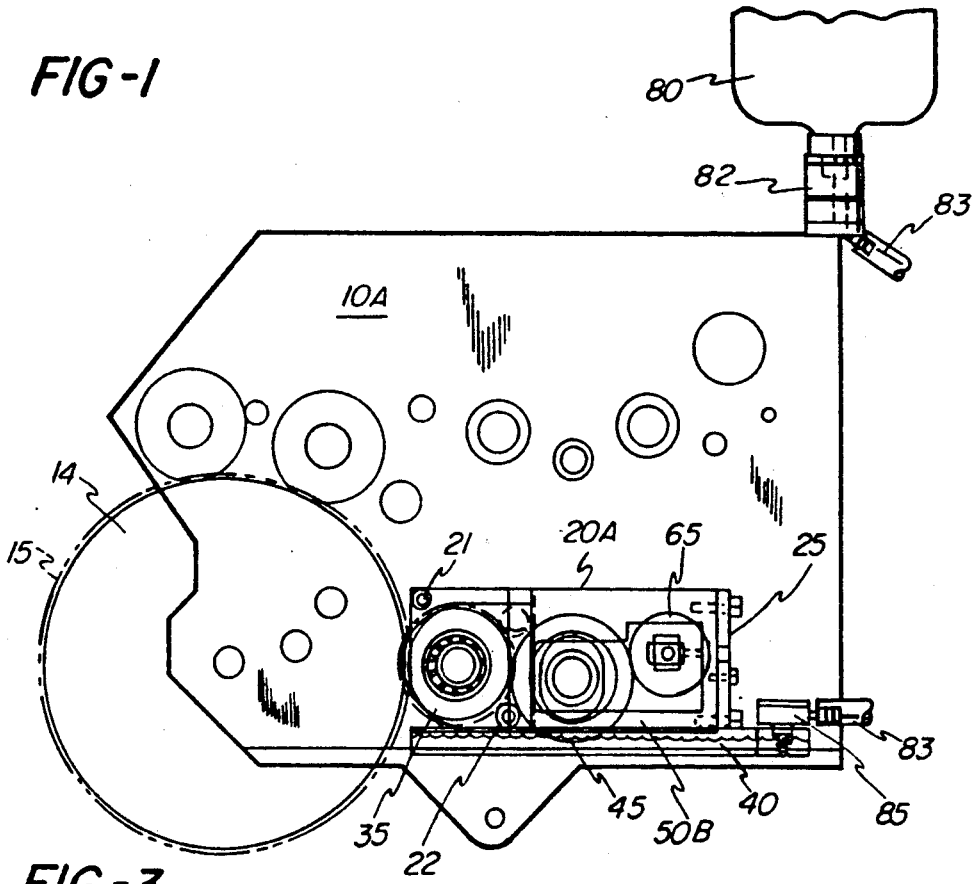
FIG. 1 is a side view of the dampener fitted to a second color unit, which is intended to be in turn fitted to a conventional small offset lithographic press.

FIG. 1 shows a dampener built according to the present invention, fitted to a commercially available second color adapter unit which in turn is intended to be fitted to a small offset lithographic press. It should be understood that the dampener can be installed directly on an offset lithographic press, and that the unit illustrated is intended merely to show one form of typical installation.

Figure 2:
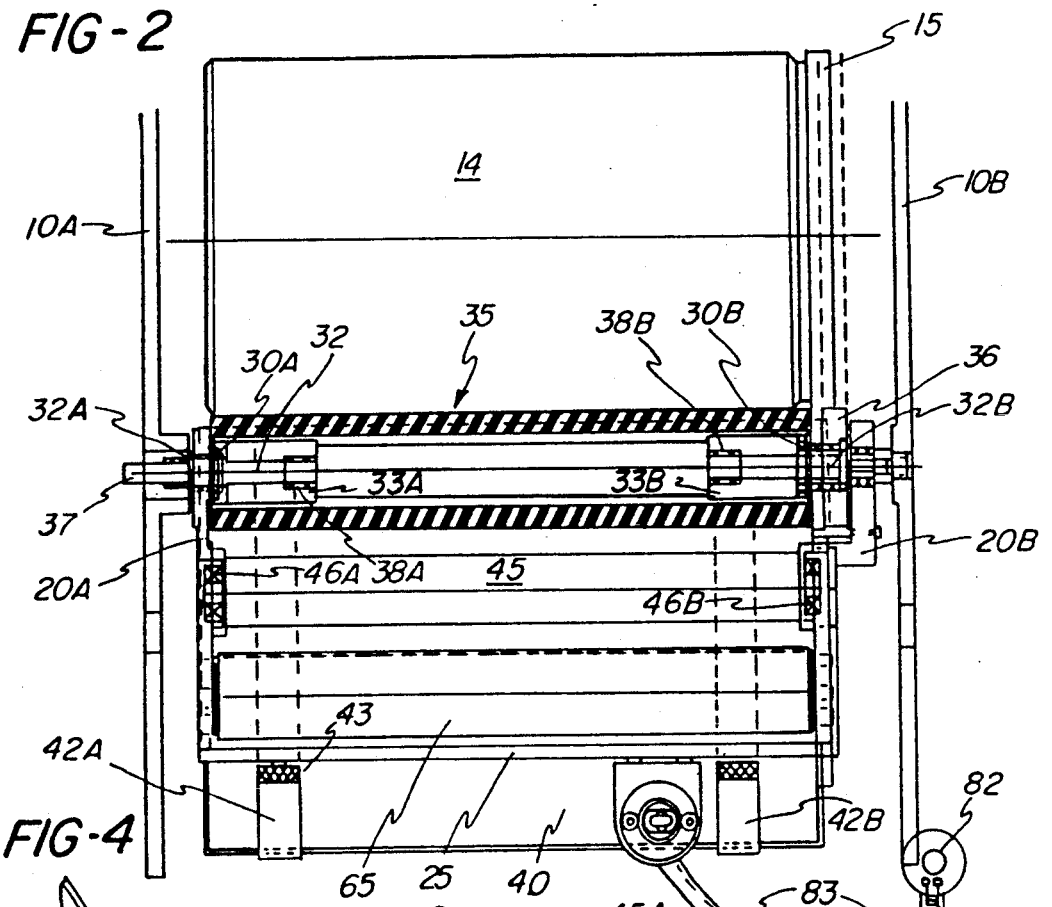
FIG. 2 is a top view of the dampener structure, with the form roller shown in cross-section.

The adapter unit includes side frame members 10A and 10B (FIGS. 1 and 2) which are typical of such press construction, supporting a plate cylinder 14 and its drive gear 15. The circles above the plate cylinder in FIG. 1 represent rollers of an inking train, which form no part of the invention. Other press structure is omitted for simplification, since it does not form part of the invention, and is generally known.

The dampener comprises a pair of side members 20A and 20B connected by tie rods 21 and 22, and by a rear plate or endcap 25. Each side member has a slide track opening 26A and 26B extending forward from the endcap toward the tie rods, and including a vertically enlarged rearward section 27A and 27B.

At the forward end of the side frames there are bearings 30A and 30B which support opposite ends of stub shafts 32A and 32B which extend from fittings 33A and 33B in the ends of the tubular interior of the form roller 35. Outside side member 20B there is a form roller drive gear 36 is attached to stub shaft 32B, and meshes with the plate cylinder gear 15 when the dampener is in operative position, to cause positive counter rotation of the form roller 35 and plate cylinder. A locating and supporting shaft 37 (see FIGS. 2, 10 and 11) extends through the interior of the form roller, inside needle bearings 38A and 38B within fittings 33A and 33B, and shaft 37 is received into plug-like bushings fitted into the side frames 10A, 10B, to align the form roller (and the rest of the dampener structure) with the plate cylinder and the gears, and to support the inner or forward part of the dampener structure (around form roller 35) between the press side frame members.

Figure 3:
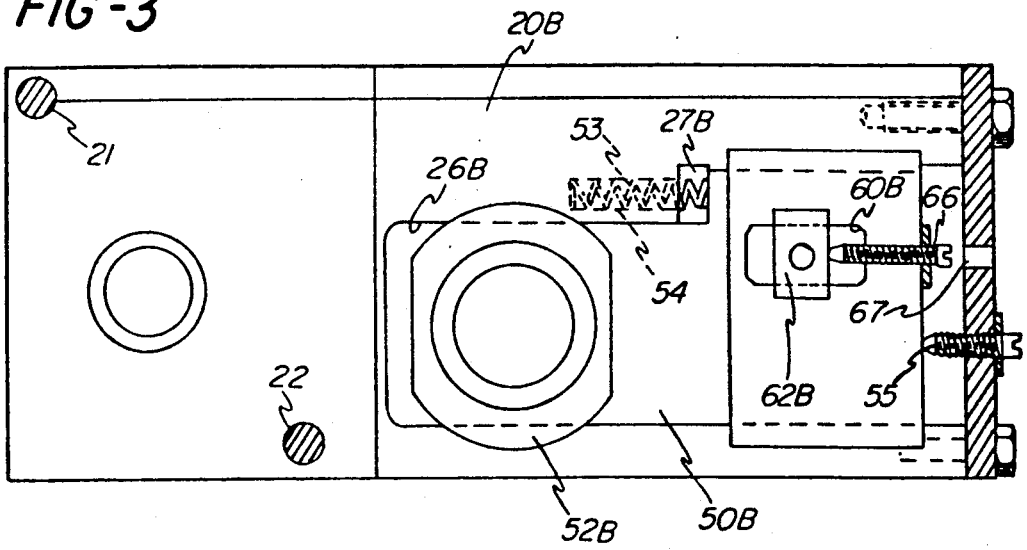
FIG. 3 is an enlarged view of the inside of the right dampener side member (as viewed from FIG. 2) and the slide block fitted therein.
Figure 4:
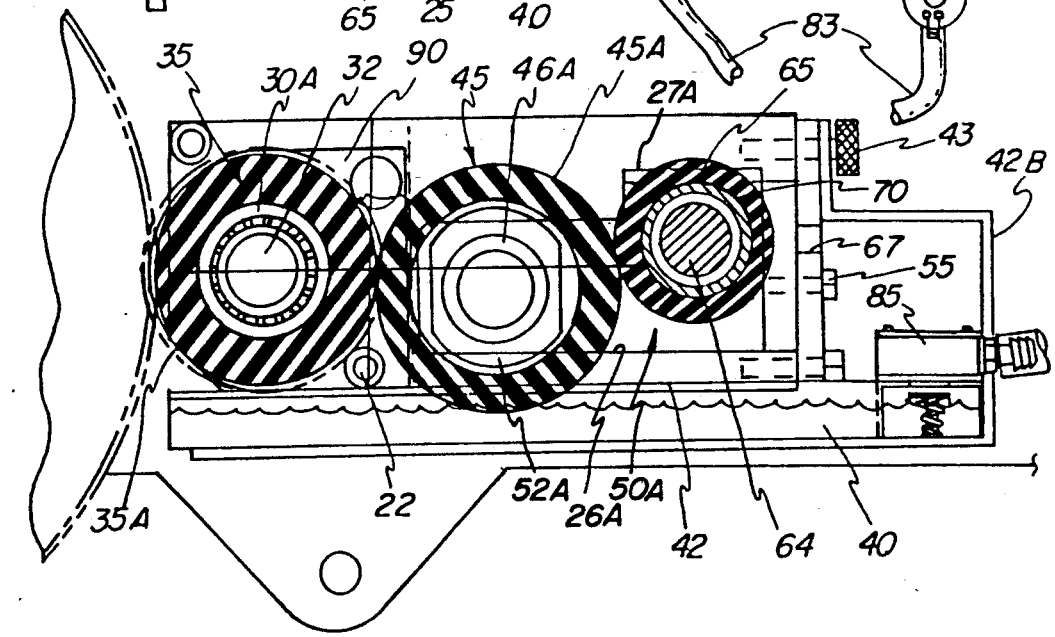
FIG. 4 is a cross-section view taken front to back of the dampener, generally along the center of FIG. 2 extending top to bottom thereof.

At the bottom of the side frames there is a shallow dampener pan 40 which has brackets 42A and 42B extending along an attached to the bottom of the pan, and at the dampener front attached to the endcap 25 by thumbscrews 43. As shown in FIGS. 3 and 4, the pan extends forward under the form roller 35, and rearward beyond endcap 25.

The metering roller 45 is supported in bearings 46A and 46B at its opposite ends, with the metering roller surface normally engaging the surface of form roller 35, and with the lower portion of the metering roller surface extending into a pool of dampening liquid in pan 40, as shown in FIG. 4. Bearings 46A and 46B are carried in slide blocks 50A and 50B which are received in the respective track openings, and which have inwardly facing bosses 52A and 52B receiving the outer races of these bearings. Coil springs 53 extend from bores 54 in the side members, facing toward the slide blocks and urging them toward endcap 25. At each rear corner, threaded into endcap 25, are forward facing adjustment screws 55 which press against slide blocks 50A and 50B, urging them forward against springs 53, and thus setting the pressure of metering roller 45 against form roller 35.

Thus, the rollers 35 and 45 are comparable to the form roller and metering roller as described in said U.S. Pat. No. 4,455,938, and act to mix or mill the dampening liquid/ink mixture on the roller surfaces. The surface 35A of form roller 35 is formed of a suitable rubber-like material, and is more soft or resilient than the surface 45A of the metering roller. Thus screws 55 may be operator adjusted to produce a desired pressure at the form roller/metering roller nip and this will result in some deformation of the form roller surface 35A at such nip. If the region above the dampener structure is to be open to operator access during operation (in the embodiment shown that nip is under other press structure) a cover may be added over the dampener rollers.

Slide blocks 50A and 50B also have horizontally elongated slot-like apertures 60A, 60B in their enlarged rearward portions, receiving smaller slide blocks one of which is shown at 62B (FIG. 3) that carry the ends of a shaft 64 which supports an oscillator roller 65. The ends of shaft 64 are fixed to the smaller slide blocks so the shaft does not rotate. Adjusting screws 66 are threaded through the rear ends of slide blocks 50A and 50B and extend into contact with the smaller slide blocks. Access to screws 66 is provided through bores 67 in endcap 25.

Figure 7:
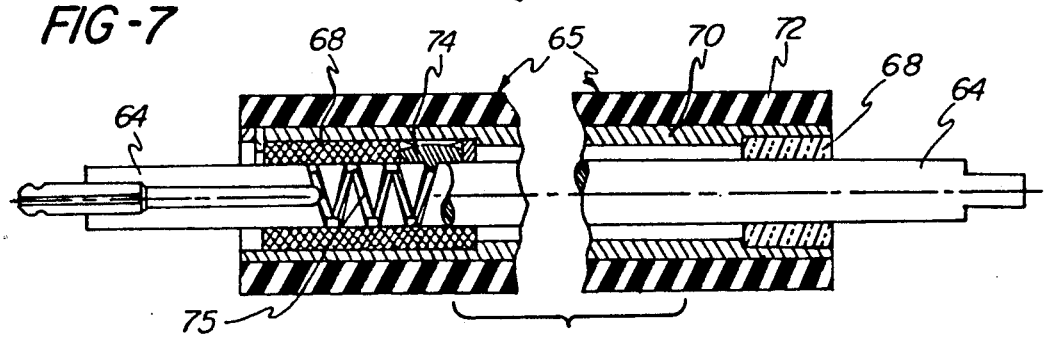
FIG. 7 is a cross-section view of the oscillator roller and its shaft and oscillating mechanism.

The interior of the oscillator roller is shown in FIG. 7. Shaft 64 has sleeve bearings 68 at its opposite ends, supporting the inner tube 70 of the roller, which in turn carries the outer roller sleeve 72. One sleeve bearing 68 is elongated, and holds a follower button 74 therein, which button engages a reversing helical track 75 formed in shaft 64. As the oscillator roller 65 turns, due to friction drive from the metering roller and form roller, button 74 moves along track 75, causing a side-to-side excursion of oscillator roller 65 in a known manner. This produces a spreading action of the mixed ink and dampening liquid on the metering roller surface 45A, at the region where additional dampening liquid has been picked up by that surface from the pool in pan 40.

Figure 10:
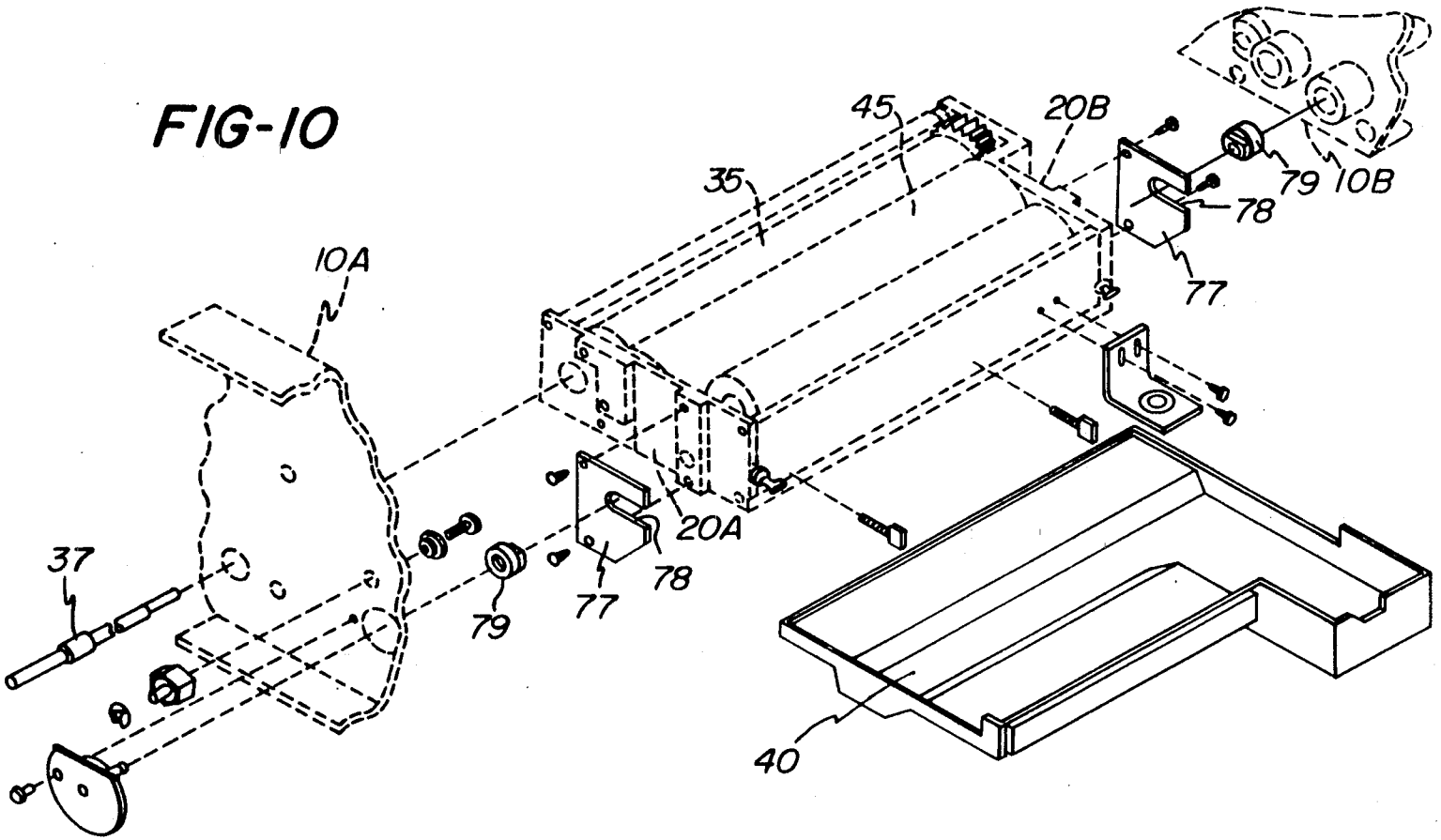
FIG. 10 is an exploded perspective view of one form of mounting of the dampener structure (shown in phantom) between typical press side frame members.

Outer end support brackets 77 are secured to the outside of the dampener side members 20A and 20B, as shown in FIG. 10. Slots 78 in brackets 77 fit around flats formed on support bushings 79, which are in turn fitted into the press side frame members 10A, 10B. To mount the dampener, the unit is brought upward and forward to engage brackets 77 to bushings 79, then the dampener structure is swung upward to align the form roller center with the apertures in the press side frames, and the shaft 37 is inserted and secured.

In operation, the pressure setting of metering roller 45 against form roller 35 is achieved by adjusting screws 55, and pressure of oscillator roller 65 against metering roller 45 is achieved independently by adjusting screws 66. Additional dampening liquid is carried from pan 40 into the nip between rollers 35 and 45.

Figure 5:
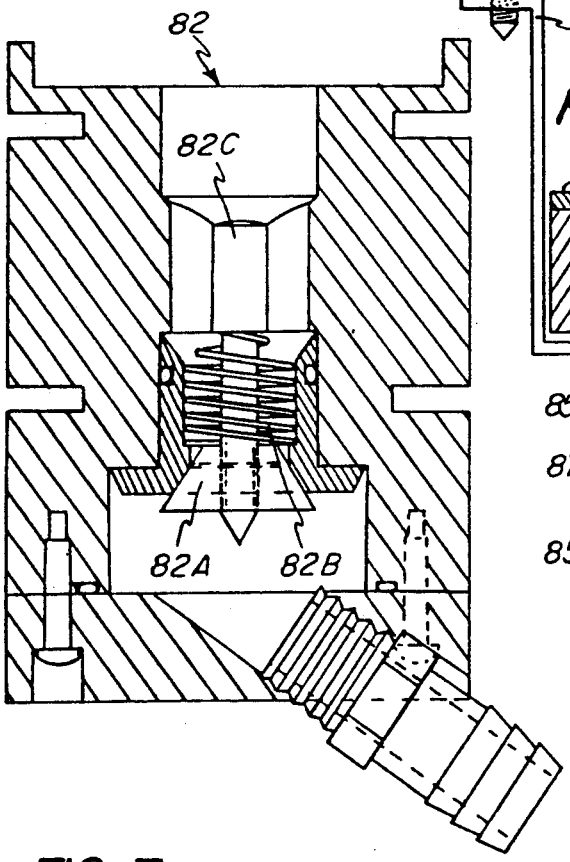
FIGS. 5 and 6 are enlarged cross-section views showing the control valves in the dampening liquid supply system, and the relation of the lower valve to the dampener pan.

Dampening liquid is replenished in pan 40 from a remote supply bottle 80 (FIG. 1) through a control valve 82 (see also FIG. 5). This valve has a valve head 82A which is normally seated by pressure of spring 82B. When a bottle is properly in place thereon, its neck thrusts on the upper end 82C of the valve head and opens the valve so long as a bottle is in place.

Figure 6:
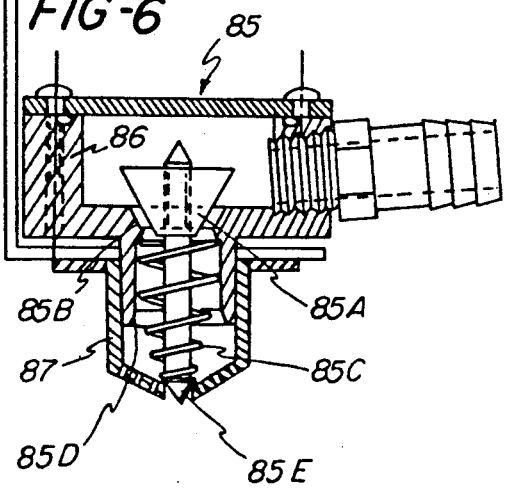

Valve 82 is connected via a flexible tube 83 to a further control valve 85 (see also FIG. 6), which has a valve head 85A urged toward a seat 85B by spring 85C. The housing 86 of valve 85 is fitted into a socket 87 which is in turn supported from a bracket 88 which is vertically adjustably mounted to endcap 25. Socket 87 leaves the lower edge 85D open to communicate with the interior of pan 40. Valve stem 85E will engage the bottom of socket 87, and open the valve, and the entire valve assembly can be vertically adjusted relative to pan 40, by turning thumbscrew 89. In this fashion, the height of liquid in pan 40 is determined by the height adjustment of the lower edge of the valve body, relative to the bottom of pan 40. When the liquid level falls below the end of the valve housing, air will pass through valves 85 and 82, via tube 83, and liquid will flow from the bottle until the liquid level in the pan cuts off the air return to the bottle, in known manner.

Figure 8:
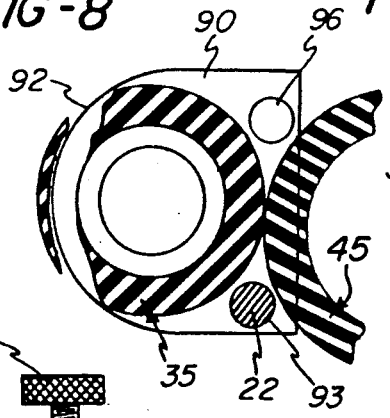
FIGS. 8 and 9 are partial side and end views of the seal dams, showing their relationship to the ends of the form and metering rollers.
Figure 9:
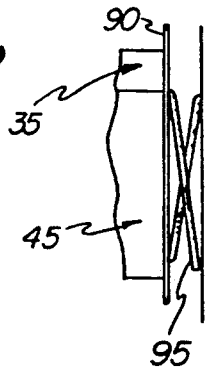

Referring to FIGS. 8 and 9, the nip region between form roller 35 and metering roller 45 is shown on an enlarged scale, and one of the end dam seal plates 90 is illustrated, fitted against the outer ends of those rollers. This plate is formed from a thin flexible material, such as Mylar, and has a rounded forward edge 92 which generally conforms to the contour of form roller 35. A central hole (not shown) in the seal plate fits around the form roller shaft, and a further hole 93 fits around tie rod 22, thus holding the plate against rotation. A suitable spring 95 (shown schematically in FIG. 9) presses the plate against the ends of the rollers, it being understood that these ends are in the same vertical plane since the rollers are of the same length. The spring pressure is sufficient to keep the seal plate 90 seated, but not to prevent some leakage of liquid between the plate and the ends of the rollers, returning to pan 40 which extends under the nip (see FIGS. 1 and 4). An overflow hole 96 in at least one of the seal plates allows excess build up of liquid in the nip reservoir to pass and drop directly into pan 40, thus establishing the maximum capacity of the liquid pool in that nip.

Figure 11:
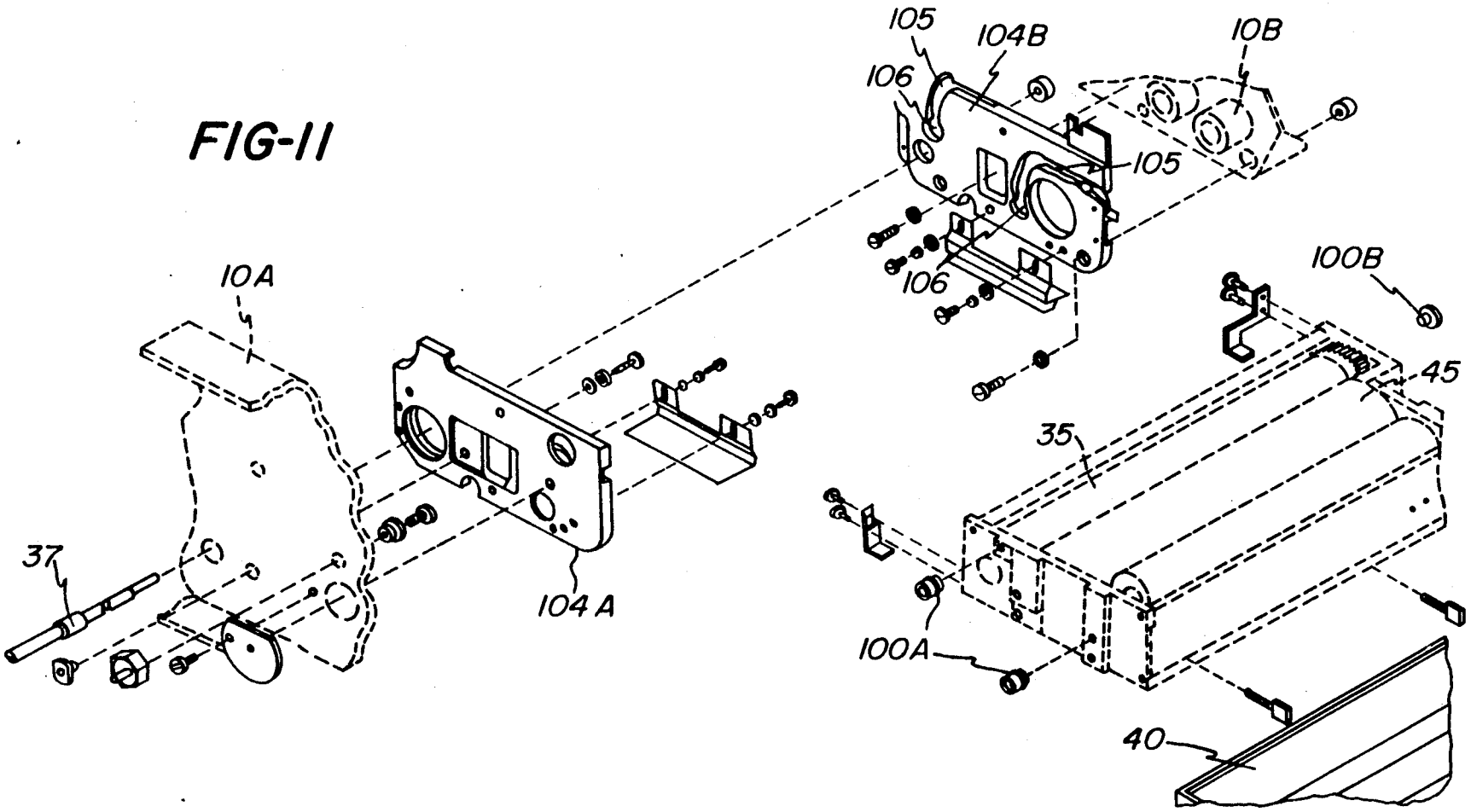
FIG. 11 is a similar exploded perspective view of a slide-type mounting for the dampener (again shown in phantom), fitted to the inside surfaces of press side frame members.

Referring to FIG. 11, the alternative form of dampener mounting is illustrated. In this configuration, roller bearings 100A and 100B are mounted to the outsides of the dampener side members. Track members 104A and 104B are secured to the interior side of press side frame members 1OA, 1OB. Each track member has formed, on its inside surface facing the dampener, a cooperating pair of generally inverted L-shaped tracks 105. These tracks terminate in locating sockets 106, and are designed to receive the roller bearings 100A, 100B, and to guide these in and out of the sockets. Thus, the dampener has a generally draw-like design which allows it to be rolled in and down to its operative position, and to be lifted and withdrawn for servicing.

While the forms of apparatus herein described constitutes preferred embodiments of this invention, it is to be understood that the invention is not limited to these precise forms of apparatus, and that changes may be made therein without departing from the scope of the invention which is defined in the appended claims.

What is claimed is:

1. A dampener for a lithographic press, said press having spaced apart side frames including bushings and a plurality of cylinders including a plate cylinder mounted between the side frames, said dampener comprising a dampener frame including side members spaced apart to fit within the press side frames, said dampener frame having a front opening and a rear endcap extending between said side members and at least one tie rod extending between said side members adjacent the front opening, a form roller including a supporting shaft, bearing means rotatably supporting said form roller shaft in said side members with a portion of said form roller extending through said front opening, a pan attached to the bottom of said dampener frame extending between said side members and from beneath said form roller to said rear endcap, means for maintaining a pool of dampening liquid of predetermined depth in said pan, parallel guides formed in said side members extending front to back of said dampener frame, a slide block supported in each of said guides, a metering roller having bearing supports at its opposite ends, said bearing supports being carried in said guides, said metering roller being adapted to run in surface contact with said form roller and having a portion of its surface adapted to immerse in the pool in said pan, means for urging said metering roller into pressure contact with said form roller, a second pair of guides formed in said slide blocks at a location adjacent said rear endcap, an oscillator roller having a supporting shaft, end supports receiving said oscillator roller shaft and fitted in said second pair of guides, an oscillator mechanism connecting said oscillator roller to its supported shaft, means for urging said oscillator roller into pressure contact with said metering roller, brackets on said dampener frame members engagable with said bushings on the press side frames to support one end of the dampener, and a shaft extending through said form roller and into said bushings in the press sideframes to support the other end of the dampener.

2. A dampener for a lithographic press having spaced apart side frames and a plate cylinder mounted between the side frames, said dampener comprising a dampener frame including side members spaced apart to fit within the press side frames, a form roller having a compressible cylindrical surface and including a supporting shaft and bearing means rotatably supporting said shaft in said side members with a portion of said form roller extending forward of said side members, a pan attached to the bottom of said dampener frame extending between said side members and from beneath said form roller to the rear of said side members, means for maintaining a pool of dampening liquid of predetermined depth in said pan, guide slots formed in said side members extending front to back of said dampener frame, a slide block supported in each of said guide slots, a metering roller having bearing supports at its opposite ends carried in said slide blocks, said metering roller having a relatively incompressible surface engaging said surface of said form roller and a portion of said metering roller surface adapted to immerse in the pool in said pan, means for urging said surface of said metering roller into pressure contact with said surface of said form roller, and means for driving said form roller and said metering roller such that their surface speeds equal the surface speed of the plate cylinder.

3. A dampener as defined in claim 2, further including an oscillator roller having a supporting shaft, adjustable end supports in said guide blocks receiving said oscillator roller shaft providing for motion thereof toward and away from said metering roller, an oscillator mechanism connecting said oscillator roller to its supporting shaft, and means for urging said oscillator roller into pressure contact with said metering roller.

4. A dampener for a lithographic press having spaced apart side frames and a plate cylinder mounted between the side frames, said dampener comprising a dampener frame including side members spaced apart to fit within the press side frames, said dampener frame having a front opening, a form roller rotatably mounted in said dampener frame, a metering roller mounted parallel to said form roller including adjustable mounting means for pressing said metering roller against said form roller to form a metering roller/form roller nip above which a quantity of dampening liquid can collect, an oscillating distributor roller mounted parallel to said metering roller and including means for pressing said oscillating roller against said metering roller independent of adjustment of said metering roller to said form roller, means for moving said oscillating roller back and forth along its length during rotation thereof, a pan attached to the bottom of said dampener frame extending between said side members and beneath at least said form roller and said metering roller, means for maintaining a pool of dampening liquid of predetermined depth in said pan, a portion of said metering roller extending into such pool whereby said metering roller carries dampening liquid to the metering roller/form roller nip, said form roller having a compressible cylindrical surface and including a supporting shaft and bearing means rotatably supporting said shaft in said side members with a portion of said form roller extending forward of said side members, means adapted for attachment to the press side frames and providing support for said dampener frame members, whereby the dampener can be inserted and removed as a unit into operative position between the press side frames.

5. A dampener for a lithographic press having spaced apart side frames and a plurality of cylinders including a plate cylinder mounted between the side frames, said dampener comprising a dampener frame including side members spaced apart to fit within the press side frames, said dampener frame having a front opening and a rear endcap extending between said side members, a form roller including a supporting shaft, bearing means rotatably supporting said form roller shaft in said side members with a portion of said form roller extending through said front opening, a pan attached to the bottom of said dampener frame extending between said side members and from beneath said form roller to said rear endcap, means for maintaining a pool of dampening liquid of predetermined depth in said pan, a pair if guides formed in said side members extending front to back of said dampener frame, a slide block supported in each of said guides, a metering roller having bearing supports at its opposite ends, said bearing supports being carried in said guides, said metering roller being equal in length to said form roller and being adapted to run in surface contact with said form roller with a portion of the metering roller surface adapted to immerse in the pool in said pan, means for urging said metering roller into pressure contact with said form roller forming a nip therebetween into which dampening liquid is carried by said metering roller, a seal plate at each end of said nip pressing against the ends of said rollers at and slightly above said nip to confine a small quantity of liquid in said nip.

6. A dampener for a lithographic press having spaced apart side frames and a plate cylinder mounted between the side frames, said dampener comprising a dampener frame including side members spaced apart to fit within the press side frames, said dampener frame having a front opening, a form roller rotatably mounted in said dampener frame, a metering roller equal in length to said form roller and mounted parallel to said form roller including adjustable mounting means for pressing said metering roller against said form roller to form a metering roller/form roller nip above which a quantity of dampening liquid can collect, seal plates contacting the sides of said form roller and metering roller at said nip to confine a quantity of liquid in the nip, an oscillating distributor roller mounted parallel to said metering roller and including means for pressing said oscillating roller against said metering roller independent of adjustment of said metering roller to said form roller, means for moving said oscillating roller back and forth along its length during rotation thereof, a pan attached to the bottom of said dampener frame extending between said side members and beneath at least said form roller and said metering roller, means for maintaining a pool of dampening liquid of predetermined depth in said pan, a portion of said metering roller extending into such pool whereby said metering roller carries dampening liquid to the metering roller/form roller nip, and said form roller having a compressible cylindrical surface and including a supporting shaft and bearing means rotatably supporting said shaft in said side members with a portion of said form roller extending forward of said side members.

7. A dampener as defined in claim 6, further including means adapted for attachment to the press sideframes and providing an adjustable support for said dampener frame members, whereby the dampener can be moved as a unit toward and away from the plate cylinder to control the pressure of said form roller against a plate on the plate cylinder independently of the pressure adjustment of the metering roller/form roller nip.

* * * * *

UNITED STATES PATENT AND TRADEMARK OFFICE

CERTIFICATE OF CORRECTION

PATENT NO. : 5,134,935

DATED : August 4, 1992

INVENTOR(S) : Thomas Hayes and Robert Wall

It is certified that error appears in the above-identified patent and that said Letters Patent is hereby corrected as shown below:

Title page, item [73],

Correct the Assignee to Read: Varn Products Company, Inc.

Signed and Sealed this

Fourth Day of April, 2000

*Attest:*

Q. TODD DICKINSON

*Attesting Officer*

*Director of Patents and Trademarks*